United States Patent [19]

Sohl et al.

[11] 4,353,656

[45] Oct. 12, 1982

[54] MOVING COIL, MULTIPLE ENERGY PRINT HAMMER SYSTEM INCLUDING A CLOSED LOOP SERVO

[75] Inventors: Gordon Sohl, Richardson; John R. Masters, Dallas; John R. Leicht, Bedford, all of Tex.

[73] Assignee: Xerox Corporation, Stamford, Conn.

[21] Appl. No.: 196,494

[22] Filed: Oct. 14, 1980

[51] Int. Cl.[3] ..... B41J 19/00

[52] U.S. Cl. ..... 400/157.3; 400/166; 361/159

[58] Field of Search ..... 400/157.3, 166; 101/93.03; 361/159

[56] References Cited

U.S. PATENT DOCUMENTS

| | | | |
|---|---|---|---|
| 3,279,362 | 10/1966 | Helms | 101/93 C |
| 3,628,644 | 12/1971 | Cralle et al. | 400/157.3 X |
| 3,678,847 | 7/1972 | Pear, Jr. et al. | 101/93 C |
| 3,834,306 | 9/1974 | Gilbert et al. | 101/93 C |
| 4,062,285 | 12/1977 | Deetz et al. | 101/93.02 |
| 4,192,230 | 3/1980 | Blom et al. | 101/93.03 |

FOREIGN PATENT DOCUMENTS

| | | | |
|---|---|---|---|
| 26387 | 4/1981 | European Pat. Off. | 101/93.03 |

OTHER PUBLICATIONS

IBM Tech. Discl. Bulletin, Mills et al., vol. 15, No. 8, 1/73, p. 2356.

IBM Tech. Discl. Bulletin, Kane et al., vol. 22, No. 12, 5/80, p. 5231.

Xerox Discl. Bulletin, Deetz, vol. 22, No. 2, 3/79, p. 153.

IBM Tech. Discl. Bulletin, Mathews, vol. 18, No. 11, 4/76, pp. 3533–3534.

*Primary Examiner*—Edward M. Coven

[57] ABSTRACT

For use in an electronic printing system having a serial impact printer, apparatus is provided to accurately control the velocity of the print hammer during printing and provide accurately controlled impact energy, which is proportional to the character face area. The apparatus includes a servo feedback system where the primary driver for the print hammer is a moving coil in a magnetic field, and the velocity sensing required for the servo feedback loop is the back emf in the moving coil with the back emf being proportional to the hammer velocity.

4 Claims, 6 Drawing Figures

MOVING COIL, MULTIPLE ENERGY PRINT HAMMER SYSTEM INCLUDING A CLOSED LOOP SERVO

The present invention relates in general to print hammers for impact printers and, more particularly, to apparatus for accurately controlling the velocity of the print hammer during printing.

The advent of programmable printing machines, such as automatic typewriters in word processing systems, has been very popular among businesses because of the speed and accuracy with which documents may be prepared. Another requirement for word processing systems is good print or copy quality on the printed documents. In impact printers, the print hammer impact energy is very important with respect to the resulting print quality, and the desired print hammer impact energy is important with respect to the area of the character face that is to be printed.

U.S. Pat. No. 3,678,847 discloses a hammer firing system for pulse actuated electromagnetic hammers for a high-speed printer in which the hammers are fired by first applying a firing pulse to a hammer and then applying a damping pulse to the hammer as the hammer is rebounding. The system is open loop.

U.S. Pat. No. 3,834,306 discloses print hammers in a printer which are energized from a source of electrical energy whose voltage may vary. The motor driving the type carrier is energized from an oscillator whose frequency is caused to vary with the voltage of the print hammer source to prevent misregistration between the print hammers and the type characters on the type carrier.

U.S. Pat. No. 4,062,285 discloses a hammer-type impact printer in which the hammer is electromagnetically driven in response to an energizing current, which decays with a predetermined time constant from a high initial level toward a set point level, which is automatically adjusted for different classes of characters so that the impact energy imparted to the hammer is regulated as a function of the character being printed. The system is open loop.

U.S. Pat. No. 3,279,362 discloses a print hammer comprised of a rigid coil structure carrying an impact tip thereon, which is supported on a pair of flexible conductive members for substantially rotational movement between a rest position and an impact position. The rigid coil structure is positioned to be in the magnetic field provided by permanent magnets.

In the prior art printers, the hammer drive systems are either single energy or multiple energy systems, which are open loop. In the multiple energy open loop hammer drive systems, four energy levels are about the maximum number that could previously be used with any degree of control because once the hammer was fired, there was no monitoring of the actual hammer velocity or correction thereto.

The invention as claimed is intended to provide a solution for various prior art deficiencies, including the problem of how to provide a wider range of hammer impact energies and then control these hammer impact energies more accurately. It would also be desirable to keep the printing speed of printer high while accurately controlling the hammer impact energies to provide good print quality of the printed matter.

The advantages offered by the invention are mainly to accurately control hammer energies over a larger range of hammer impact energies, thereby being able to fine-tune the hammer impact energy to the character face area and provide better print quality for all the printed characters. Another advantage offered by the invention is that it minimizes print cycle time while finely controlling the impact energy over a wide range of impact energies.

One means for carrying out the invention is described in detail below with reference to the drawing, which illustrates only one specific embodiment, in which.

Figure 1:
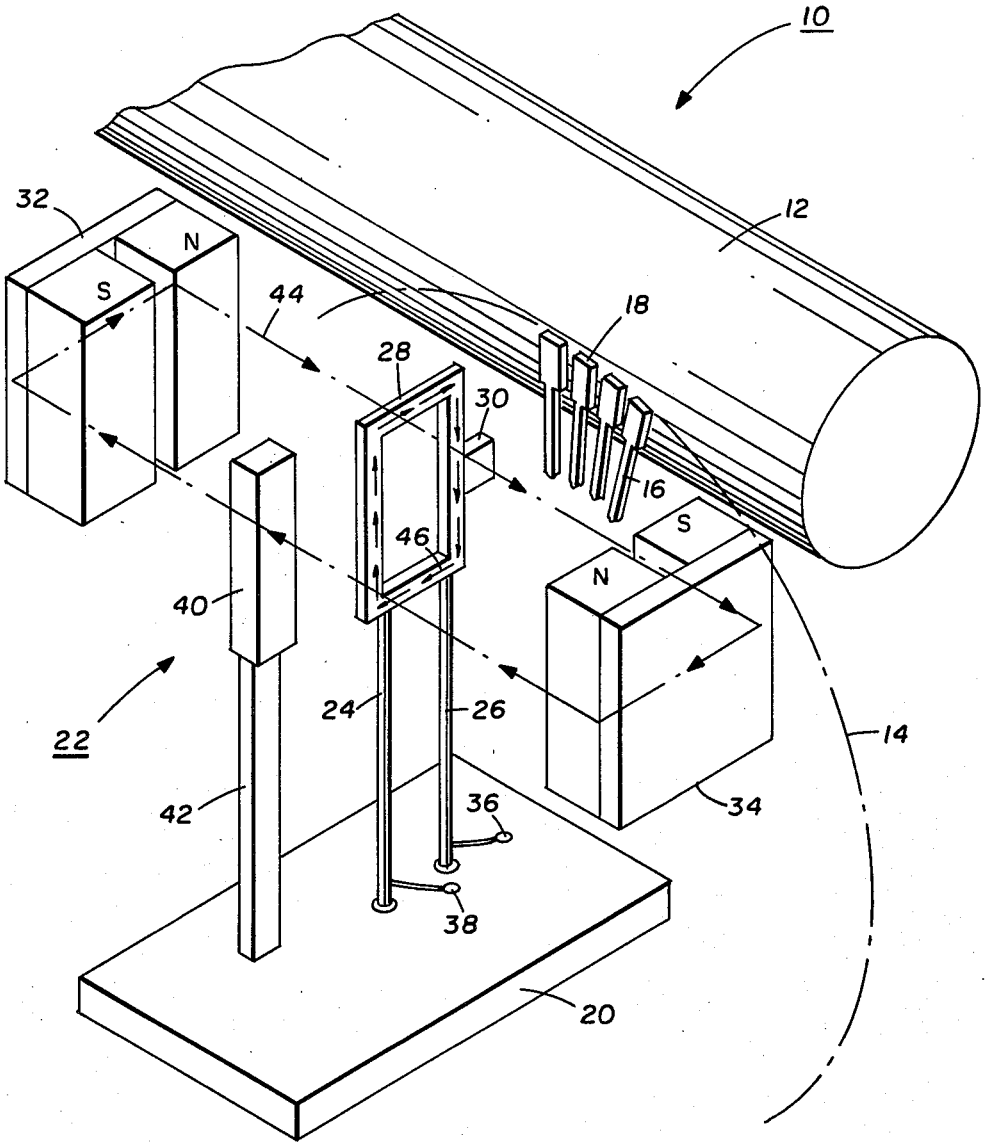
FIG. 1 is a simplified perspective view of an impact printer illustrating a hammer mechanism, a print wheel and a platen with an exploded view of the hammer mechanism while at rest.

Referring now to FIG. 1, there is illustrated a subassembly of an impact printer 10 comprising a platen 12, and rotatable print wheel 14 having radially extending spokes 16 with character pads 18 at the free ends thereof. A movable carriage member 20 is removably secured to guide rails (not shown) and is capable of moving along the platen 12 on the guide rails (not shown) in a printing relation with platen 12. A moving coil hammer 22 is resiliently supported on carriage member 20 by a pair of leaf springs 24 and 26. The moving coil hammer 22 comprises coil 28, hammer 30 and two permanent magnet assemblies 32 and 34 with one assembly positioned on each side of coil 28. Permanent magnet assemblies 32 and 34 are supported from carriage member 20, but, because of the exploded view to expose coil 28, the supports are not shown. Either magnetic assembly 32 or 34 could be replaced by a soft iron pole piece if the remaining magnet assembly was of sufficient strength to support the required field, thereby simplifying the mechanical assembly. Leaf springs 24 and 26 are conductive and supply the means for energizing coil 28 through terminals 36 and 38. Backstop 40 is mounted behind coil 28 on the side opposite platen 12 and is supported from carriage 20 by post 42.

The poles on magnetic assembly 32 are positioned across from poles of opposite polarity on magnetic assembly 34. When current is initiated in coil 28 in one direction, a force is exerted on hammer 30 to direct the hammer 30 in one direction; and when a current is initiated through coil 28 in the opposite direction, a force is exerted on hammer 30 to direct the hammer 30 in the opposite direction. Therefore, by energizing coil 28 in the proper direction, the coil 28 and attached hammer 30 will be propelled away from backstop 40 and toward the platen 12 to impact hammer 30 against the character pad 18 of a particular print wheel spoke 16 to press the same against a ribbon (not shown), a sheet of paper (not shown) and the platen 12 to impress the particular character located on character pad 18 onto the sheet of paper. By changing the direction of current flow in coil 28, a force in a direction away from the platen is exerted on hammer 30 to direct hammer 30 toward backstop 40. The magnetic flux path 44 is shown in relation to the permanent magnetic assemblies 32 and 34 and coil 28. The flow of current 46 in coil 28 is shown for one polarity of applied voltage to terminals 36 and 38 while the flow of current 46 would be in the opposite direction for the opposite polarity of applied voltage.

The prior art printing systems of the open loop type normally provide a maximum of four different energy levels to be used in the printing of all the characters regardless of the total range of character face areas. It would be desirable to provide a greater range of hammer impact energy levels and to finely control the impact energy of the hammer over this greater range of energy levels.

To provide this desired capability, the present invention starts with a moving coil print hammer 22. The back emf generated in coil 28 as it moves through the magnetic field provided by the permanent magnetic assemblies 32 and 34 is proportional to the velocity of coil 28. By monitoring and knowing the velocity of coil 28 during its travel in the printing cycle and comparing that velocity to the desired velocity for the printing of each particular character, then a correction can be made such that the actual hammer velocity will equal the desired velocity for each character when that character is printed, thereby providing improved print quality. It is also desirable to provide the improved print quality without appreciably reducing the printing speed.

Figure 2:
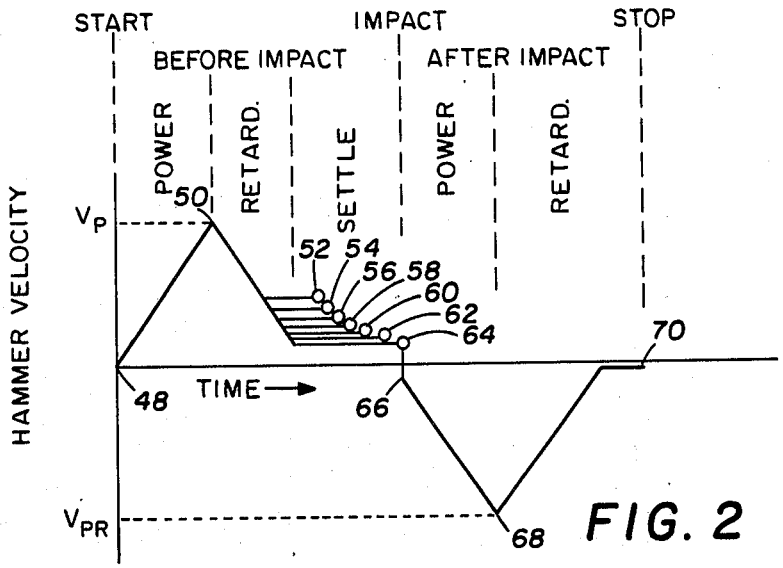
FIG. 2 is a curve of the hammer velocity versus time.
Figure 3:
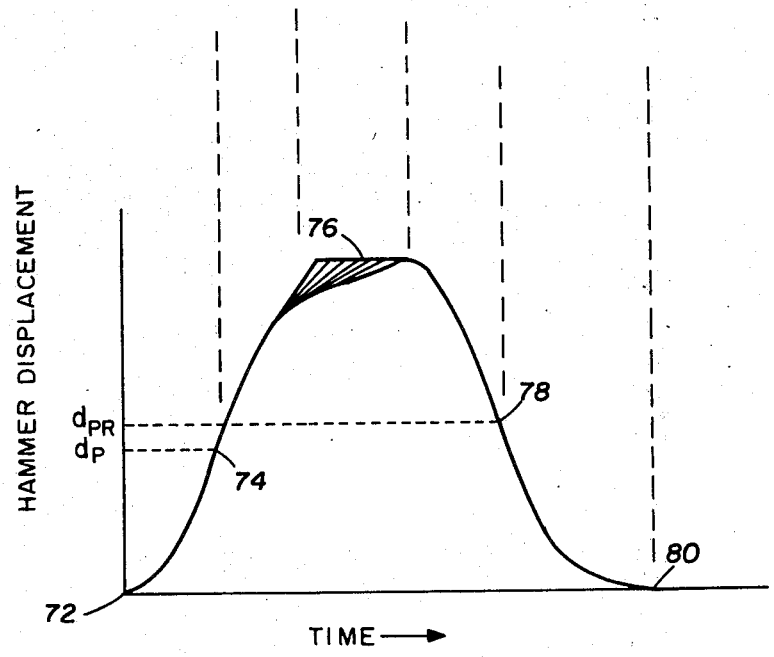
FIG. 3 is a curve of the hammer displacement versus time.

With reference to FIGS. 2 and 3, there is shown a desired hammer velocity profile and hammer displacement profile for the inventive hammer system. Referring to FIG. 2, the curve is divided into two parts with the first part being "before impact", and the second part being "after Impact". To minimize print cycle time, the print hammer is driven to a velocity higher than that velocity desired at impact, and then the hammer is decelerated to the desired impact velocity. If the printing speed was not of concern, then the hammer could be accelerated to the desired velocity and held at that velocity until impact, but that would slow down the printing speed. The velocity profile of FIG. 2 is keyed to minimum print cycle time and fine control of impact velocity. Again, with reference to FIGS. 1 and 2, the power or acceleration portion of the profile is shown between points 48 and 50. Maximum drive is applied to coil 28 until the velocity of coil 28 (and integral hammer 30) reaches the peak velocity $V_p$. At that point, the selected print velocity is commanded and a drive of the correct polarity is applied to coil 28 to reduce the velocity until the desired impact velocity 52–64 for the particular character to be printed is reached, and the drive to coil 28 is controlled to maintain the desired velocity constant until impact. After impact, maximum drive of the correct polarity is applied to coil 28 to move the coil 28 away from the platen 12 until the velocity of coil 28 (and integral hammer 30) reaches the negative retard peak velocity $V_{pr}$; this occurs at point 68. At point 68 a low reverse velocity is commanded, and a drive of the polarity to cause the velocity of coil 28 to be retarded and decelerated is applied to coil 28 to decrease the velocity of coil 28 to near zero until it arrives at the backstop at point 70. At this time, the coil 28 will be against backstop 40, and one print cycle will have been completed. This print cycle will be repeated for each printing of a character with the particular impact velocity 52–64 being dependent upon the particular character to be printed.

With reference to FIG. 3, there is shown the print hammer displacement profile during a print cycle. At the beginning of the print cycle, coil 28 (and integral hammer 30) are positioned against backstop 40 at point 72 of FIG. 3. Point 74 indicates the position of coil 28 at maximum velocity during the power phase before hammer impact. Point 76 indicates the hammer position at platen 12 while point 78 indicates the position of coil 28 at maximum velocity during the power phase after hammer impact. Point 80 indicates the position at backstop 40 and the completion of a print cycle. This system is able to control the impact energy over a larger range of impact energies then the prior art. The prior art range was typically 0.03 to 0.15 inch/lb with four levels of impact energy. With the present invention, seven levels of impact energy were possible, and the range was from 0.025 to 0.25 inch/lb with approximately 10% accuracy over the entire range. The accuracy of the prior art was typically about 30% over a smaller range.

Figure 4:
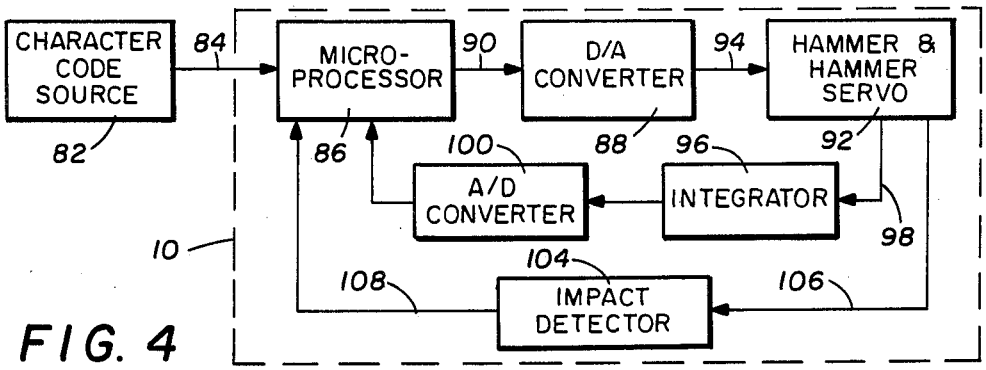
FIG. 4 is a simplified functional block diagram of the control system for the hammer.

With reference to FIG. 4, the character code source 82 inputs character code data over connection 84 to the microprocessor 86 of impact printer 10. The character code data being for those characters that are desired to be printed. The microprocessor 86 contains the desired impact velocity for each character to be printed, together with the hammer displacement and velocity profiles of FIGS. 2 and 3, so the desired hammer velocity is known for any position of hammer displacement. The digital hammer velocity command for each character is transmitted from microprocessor 86 to the D/A (digital-to-analog) converter 88 over connection 90. The analog command from the D/A converter 88 is transmitted to the hammer and hammer servo 92 over connection 94. Initially, coil 28 is at rest against backstop 40, and coil 28 of the moving coil hammer 22 is energized as a result of the analog command, which then causes coil 28 (and integral hammer 30) to move toward the platen 12. The back emf generated in coil 28, due to the movement of coil 28 through the magnetic field, is sent to integrator 96 over connection 98. The output of integrator 96 is an indication of position/displacement of coil 28 since the back emf sensed in coil 28 is proportional to the velocity of coil 28. The output of integrator 96 is sent to the A/D (analog-to-digital) converter 100 over connection 102. The analog output from the A/D converter 100 is sent to microprocessor 86 over connection 104 so the microprocessor 86 receives an indication of the position of the coil 28 (and integral hammer 30). By having an indication of the position of coil 28, the microprocessor 86 can provide the desired commands to coil 28 to assure the correct velocity of coil 28 (and integral hammer 30) at impact. An indication of back emf is also sent to impact detector 104 over connection 106. The output of impact detector 104 is sent to the microprocessor 86 over connection 108 and provides an indication to the microprocessor 86 of the occurrence of impact. The impact detector 104 detects the change in polarity of the back emf in coil 28, which occurs when coil 28 changes direction upon impact with the platen 12. The hammer servo system 92 receives the hammer command, which is in terms of a velocity command, and energizes coil 28 (with integral hammer 30). The hammer servo system 92 also monitors the back emf, which is proportional to the actual velocity of the coil 28 and hammer 30, and compares the actual velocity with the commanded velocity and makes corrections in the hammer drive as needed to obtain the correct value of actual velocity of coil 28 and hammer 30 at impact.

Figure 5:
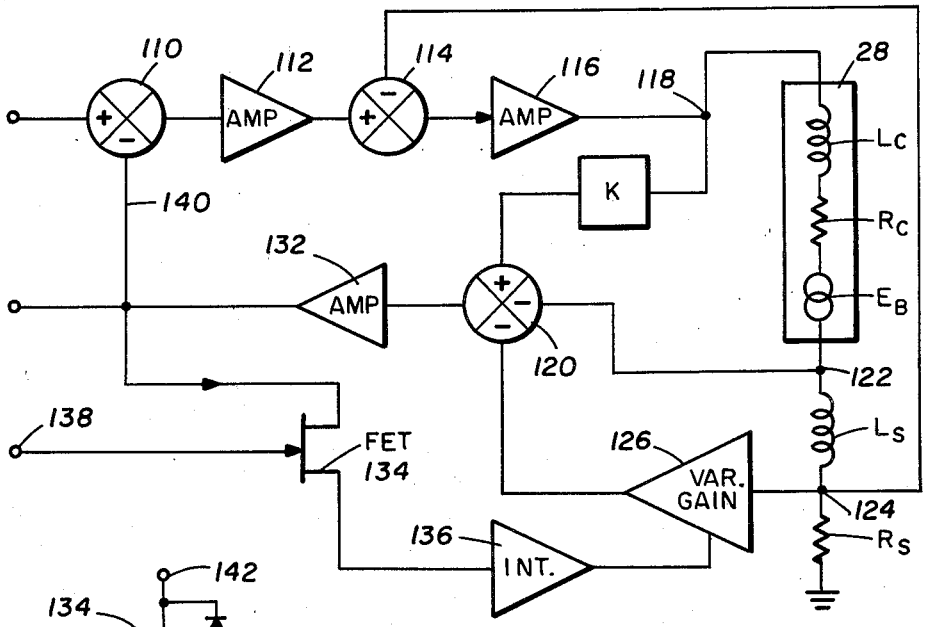
FIG. 5 is a simplified functional block diagram of the hammer and hammer servo shown in FIG. 4.

With reference to FIG. 5, the analog command from the D/A converter 88 is inputted to summing point 110 of summing amplifier 112. The output of summing amplifier 112 is inputted to summing point 114 of drive amplifier 116. The output of drive amplifier 116 is inputted to terminal 118 of coil 28 and also to summing point 120 of amplifier 132 through ratio factor $K_l$ with $K_l$ being equal to $L_s/(L_c+L_s)$. Coil 28 can be broken into three elements; an inductive element $L_c$; a resistive element $R_c$, whose value varies with temperature and increases in value as the coil 28 rises in temperature; and the back emf $E_b$, which generates a voltage as a result of coil 28 moving through the magnetic field provided by the moving coil hammer assembly 22. Coil 28 is driven by driver amplifier 116, and there are two elements in series with coil 28 for sensing both the current through coil 28 and the rate of change of the current through coil 28. The two series elements are a small inductor $L_s$ and a small resistor $R_s$. In order to obtain a signal that is proportional to the velocity of coil 28, it is necessary to separate and measure the back emf $E_b$ from coil 28; therefore, it is necessary to eliminate the inductive term $L_c$ (di/dt), which is induced as the current changes through coil 28, and also to eliminate the $iR_c$ drop from the basic drive voltage across coil 28. The $L_c$ (di/dt) term is removed by taking the voltage at terminal 122 at the top of small inductor $L_s$ and subtracting this voltage at summing point 120 from the applied voltage to coil 28 at terminal 118. This subtraction also removes some of the $IR_s$ drop because the voltage being fed back from terminal 122 is taken from above the series combination of $L_s$ and $R_s$. The remaining portion of the $IR_s$ drop is removed by feeding the voltage sensed at terminal 124 through variable gain amplifier 126, which multiplies the voltage at terminal 124 by an appropriate constant, and then to summing point 120 of amplifier 132 whose output is an indication of back emf. Current feedback is provided from terminal 124 to summing point 114; said current feedback causes the servo system to respond more quickly to the velocity error output of amplifier 112.

By the calculation of the $IR_s$ drop, the current into coil 28 is made independent of any changes in resistance $R_s$. The gain constant of variable gain amplifier 126 for canceling the residual $IR_s$ drop is determined in the following manner. With the coil 28 (and integral hammer 30) positioned at the backstop 40, a slight negative command is inputted to the hammer servo system 92 from the D/A converter 88. This command results in a current through coil 28, $L_s$ and $R_s$, which tends to drive the coil 28 (and integral hammer 30) into backstop 40. The coil 28 at the backstop is at rest and is not moving; therefore, the output from summing amplifier 122 should be zero because there is no back emf. To the extent that there is an output from summing amplifier 132, that is an indication that the residual resistance term $R_s$ has not been properly balanced out of the system since the current is a constant, and there is no $L_c$ (di/dt) term. Therefore, the output of summing amplifier 132 is provided through FET 134 as an input to integrator 136. FET 134 is turned on by a command from microprocessor 86, which is inputted at terminal 138. The output of the integrator 136 is inputted to variable gain amplifier 126 to control the gain constant of the variable gain amplifier 126. If the input to integrator 136 is of one given sign, then the output of integrator 136 will increase the gain of variable gain amplifier 126 to increase the amount of cancelation of the resistance term $R_s$ until the point is reached where the cancelation is perfect, and the system is balanced. At that point, the input to the integrator 136 is zero, and the value will then hold at that point while the coil 28 is at rest. If the output from summing amplifier 132 is of the opposite sign, then the output of integrator 136 will reduce the gain of variable gain amplifier 126 until the resistance term $R_s$ is canceled out, and the system is brought into balance. This type of adjustment or check is performed at various times when the coil 28 (and integral hammer 30) is not actively printing and is initiated by microprocessor 86 by commanding a small negative command and activated FET 134.

The output of summing amplifier 132 is the back emf voltage, which is proportional to the velocity of coil 28. The back emf voltage is inputted to integrator 96 (see FIG. 4) whose output goes to the A/D converter 100 (see FIG. 4). The output of the A/D converter 100 (see FIG. 4) is transmitted back to microprocessor 86 to provide hammer position to the microprocessor 86 so the microprocessor 86 can then make the decision as to when to change the velocity commands to coil 28. The back emf signal from summing amplifier 132 is also fed back to summing point 110 through cable 140 where it is compared with the velocity commanded from microprocessor 86, and correction will be made when necessary.

Figure 6:
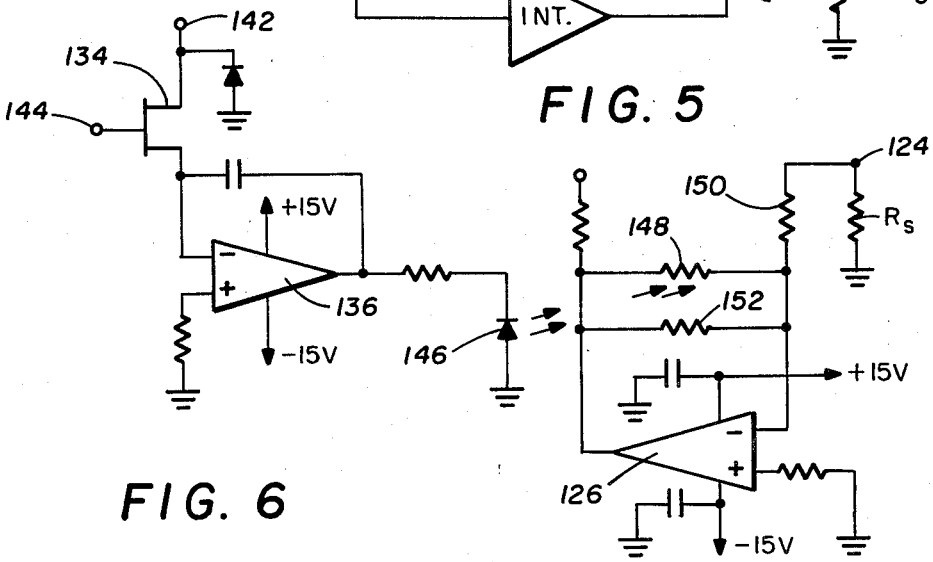
FIG. 6 is a simplified schematic of the variable gain amplifier shown in FIG. 5.

With reference to FIG. 6, details of the FET 134, integrator 136 and variable gain amplifier 126 are shown. The back emf is applied to terminal 142 while the activation signal for FET 134 is applied to terminal 144 from the microprocessor 86. As the drive is increased to integrator 136, LED 146 in the output of integrator 136 will emit a greater amount of light. LED 146 is positioned such that the light therefrom falls on photoresistor 148 in the feedback loop of variable gain amplifier 126. As the incident light from LED 146 increases, the resistance of photoresistor 148 will decrease. As in a typical operational amplifier, the gain is the feedback resistance divided by the input resistance. In this case, the input resistance is resistor 150 and the feedback resistance in the parallel combination of resistor 152 and photoresistor 148. The parallel combination of feedback resistance keeps the variable gain amplifier 126 from going unstable when LED 146 is not driven and is not emitting light. When LED 146 is not driven, photoresistor 150 will be dark, and the impedance will be very high; and this would cause the variable gain amplifier 126 to have extremely high gain without resistor 152 being in parallel with photoresistor 150. Resistor 152 puts an upper limit on the gain of the variable gain amplifier 126. If the output of integrator 136 is zero, then the gain of variable gain amplifier 126 will be at its maximum, and we will be overcompensating for the resistance of coil 28. The phasing of integrator 136 is set so that with overcompensation, the output of integrator 136 is driven negative, which turns on LED 146, and the gain of the variable gain amplifier 126 is reduced until the system is brought into balance. During the hammer fire time, the input to the integrator 136 is opened up so that the output of integrator 136 just holds constant, and the gain of the variable gain amplifier is held constant.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. A printing system having a moving coil hammer for use with an independently operable printing machine having a platen, a print element containing predetermined characters and a carriage for traversing said platen, said print hammer system comprising:

means for creating a permanent magnetic field in the area of said hammer, means for generating a velocity command which is the velocity profile for the character to be printed, means for converting said velocity command into a current, a coil connected to said hammer and coupled to said current for moving said hammer against and away from said print element, a resistor in series with said coil for generating a voltage proportional to the voltage dropped by the internal resistance of said coil, an inductor in series with said coil for generating a voltage proportional to the voltage dropped by the inductance of said coil, means for determining the velocity of said hammer by calculating all resistance and inductance voltages in the coil circuit and subtracting said voltages from the total voltage applied by said means for converting, the remainder equaling the back emf voltage of the coil which is a voltage proportional to the hammer velocity, wherein said means for generating is responsive to said hammer velocity voltage determination to generate an updated velocity command, and wherein said means for determining further includes a variable gain amplifier to provide compensation for any changes in the resistance of said coil in the moving coil hammer due to changes in the temperature of said coil, thereby allowing the sensed velocity of the moving coil hammer to be independent of any changes in the resistance of the coil in the moving coil hammer.

2. Apparatus as recited in claim 1 wherein said variable gain amplifier includes:

an amplifier including a variable resistance feedback element, said feedback element being photoresistive and operatively positioned to be illuminated by a photoemitter, said photoemitter being operatively connected to said sensing means such that energy emitted from said photoemitter is capable of varying with the actual velocity of said moving coil hammer, whereby the resistance of said feedback element is caused to change in value as said emitted energy changes and changes the gain of said amplifier in a controlled fashion.

3. Apparatus as recited in claim 2 further including:

drive means connected to said photoemitter and being capable of varying the drive to said photoemitter in accordance with a signal received from said sensing means, switch means connected between said drive means and said sensing means, said switch means being capable of being activated to the "on" condition by a signal from said processor such that said signal from said sensing means drives said drive means, whereby the gain of said amplifier is set at a value where the sensed velocity of the moving coil hammer indicates zero when the processor commands the moving coil hammer to a position of non-movement against a backstop such that the actual velocity of the moving coil hammer is zero.

4. Apparatus as recited in claim 3 wherein said sensing means further includes a variable gain amplifier to provide compensation for any changes in the resistance of said coil in the moving coil hammer due to changes in the temperature of said coil, thereby allowing the sensed velocity of the moving coil hammer to be independent of any changes in the resistance of the coil in the moving coil hammer.

* * * * *